US008855508B2

(12) United States Patent
Saikoh et al.

(10) Patent No.: US 8,855,508 B2
(45) Date of Patent: Oct. 7, 2014

(54) IMAGE FORMING APPARATUS, AND IMAGE FORMING METHOD

(75) Inventors: Hideji Saikoh, Osaka (JP); Masayasu Narimatsu, Osaka (JP); Kiyofumi Morimoto, Osaka (JP); Kazuma Hinoue, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 655 days.

(21) Appl. No.: 13/171,720

(22) Filed: Jun. 29, 2011

(65) Prior Publication Data

US 2012/0020684 A1 Jan. 26, 2012

(30) Foreign Application Priority Data

Jul. 21, 2010 (JP) ..... 2010-164117

(51) Int. Cl.

| | |
|---|---|
| ***G03G 15/08*** | (2006.01) |
| ***G03G 15/00*** | (2006.01) |
| ***G03G 15/06*** | (2006.01) |
| ***G03G 15/01*** | (2006.01) |

(52) U.S. Cl.

CPC ..... *G03G 15/065* (2013.01); *G03G 15/0131* (2013.01); *G03G 15/5058* (2013.01); *G03G 15/5041* (2013.01); *G03G 15/0851* (2013.01); *G03G 15/6505* (2013.01)

USPC ..... 399/30; 399/49; 399/55

(58) Field of Classification Search

CPC ..... G03G 15/5058; G03G 15/0824; G03G 15/5041; G03G 15/0822

USPC ..... 399/30, 49, 55

See application file for complete search history.

(56) References Cited

U.S. PATENT DOCUMENTS

| | | | |
|---|---|---|---|
| 5,504,557 | A | 4/1996 | Morita |
| 7,395,002 | B2 | 7/2008 | Funayama et al. |

FOREIGN PATENT DOCUMENTS

| | | |
|---|---|---|
| JP | 6-124031 A | 6/1994 |
| JP | 2002-040725 | 2/2002 |
| JP | 2007-128010 | 5/2007 |
| JP | 2008-107717 | 5/2008 |

*Primary Examiner* — David Gray
*Assistant Examiner* — Andrew V Do
(74) *Attorney, Agent, or Firm* — Nixon & Vanderhye P.C.

(57) ABSTRACT

Provided are an image forming apparatus that, when a difference between a developing bias in correcting an image density and a reference developing bias has a value not less than a prescribed value that is set preliminarily, replenishes or consumes a toner forcibly, executes correction of the image density again, and controls the developing bias in such a manner that a toner density is controlled to fall within an appropriate range, and an image forming method using the same. When a difference between a developing bias value after correction of the image density and the reference developing bias becomes larger than the prescribed value to the plus side or the minus side, a toner density control portion performs control to consume or replenish a toner forcibly.

4 Claims, 8 Drawing Sheets

IMAGE FORMING APPARATUS, AND IMAGE FORMING METHOD

This Nonprovisional application claims priority under 35 U.S.C. §119(a) on Patent Application No. 2010-164117 filed in Japan on 21 Jul. 2010, the entire contents of which are hereby incorporated by reference.

BACKGROUND OF THE INVENTION

1. Field of the Invention

The present invention relates to an electrophotographic image forming apparatus such as a copier, a printer or a facsimile, and an image forming method and a program using the same.

2. Description of the Prior Art

Conventionally, in an electrophotographic image forming apparatus, a developer used for forming a toner image on a photoreceptor drum is largely divided into two types. For example, there are a developer using a mono-component toner and a dual-component developer including a nonmagnetic toner and a magnetic carrier.

Since a mono-component developing system is suitable for miniaturization but not suitable for high-speed development, most of image forming apparatuses attaining high-speed and long-life employ a dual-component developing device. In this type of the developing device using a dual-component developer, a carrier itself in the dual-component developer is not consumed and remains in the developing device, thus the carrier is not reduced. On the other hand, a toner is consumed in a development operation and is reduced. Hence, in order to prevent from destabilizing image quality caused by a decrease in the toner constituting the dual-component developer, toner density control is performed in which the toner is appropriately replenished to maintain a toner density of the dual-component developer within an appropriate range.

Generally, as a method for controlling a toner density, two kinds of controlling methods are often combined. One of the methods is such that a toner consumption is calculated according to a printing rate of an input image to replenish a toner. The other method is such that a density of a reference toner image formed on the surface of an electrostatic latent image carrier (photoreceptor drum) is detected to replenish a toner based on a given density value which is determined preliminarily and a comparison result.

As part of stabilization of a toner density of a developer, Patent Literature 1 (Japanese Patent Application Laid-open No. 2007-128010) proposes a technology for controlling a toner density by forming an image density patch for correction on a photoreceptor drum periodically, comparing a density value detected by a density sensor with a preliminarily set target value, and correcting a quantity of light of an exposure apparatus and a developing bias. Moreover, a technology for controlling a toner density by correcting a preliminarily set target value itself of an image density patch based on a relation between a pixel count cumulative value and a toner supply amount cumulative value is proposed.

In the control of a toner density described above, there are problems in that, when a pixel count value of an input image is accumulated and a toner replenishment amount is determined depending on the cumulative value, it is impossible to confirm that the toner amount to be supplied based on the calculated toner replenishment amount has been replenished correctly and it is also impossible to indicate the toner amount in a developer that has been actually consumed correctly.

Thus, there is a problem that image quality of a printing image is deteriorated with the toner density out of the appropriate range.

SUMMARY OF THE INVENTION

The present invention has been devised in view of the above circumstances, and aims to provide an image forming apparatus, when a difference between a developing bias in correcting an image density and a reference developing bias has a value not less than a prescribed value that is set preliminarily, replenishes or consumes a toner forcibly, executes correction of the image density again, and controls the developing bias in such a manner that a toner density is controlled to fall within an appropriate range, and an image forming method and a program using the same.

Each component of the image forming apparatus according to the present invention for solving the above-described problem is as follows.

The image forming apparatus of the present invention includes a toner storage portion for storing a toner and a carrier; a developing portion for performing development using a dual-component developer including the toner and the carrier; a toner replenishing portion for replenishing the toner from the toner storage portion to the developing portion; a toner density detecting portion for detecting a toner density of the developing portion; a photoreceptor drum for carrying a toner image visualized by the developing portion; a toner patch forming portion for forming a toner patch for detecting an image density on the photoreceptor drum; an image density detecting portion for detecting a density of the toner patch; and a storage portion for storing a density of a reference toner patch serving as a reference of an image density and a reference developing bias value to be applied to the developing portion, which includes an image density control portion for comparing the density of the toner patch that is detected and the density of the reference toner patch to correct the image density; and a toner density control portion for controlling a developing bias value to be applied to the developing portion in such a manner as to fall within a first developing potential control range determined by a first upper threshold and a first lower threshold, and is characterized in that when a difference between the reference developing bias value and a developing bias value after correction of the image density exceeds the first upper threshold, the toner density control portion performs control to consume a toner forcibly, and when the difference between the reference developing bias value and the developing bias value after correction of the image density exceeds the first lower threshold, the toner density control portion performs control to replenish a toner forcibly.

Further, the image forming apparatus of the present invention is characterized in that the image density control portion corrects the image density again after performing the control of toner replenishment or the control of toner consumption, the toner density control portion performs control in such a manner that the developing bias value after correction of the image density falls within a second developing potential control range determined by a second upper threshold and a second lower threshold, and when the difference between the reference developing bias value and the developing bias value after correction of the image density exceeds the second upper threshold, the toner density control portion performs control in such a manner as to consume a toner forcibly, and when the difference between the reference developing bias value and the developing bias value after correction of the image density exceeds the second lower threshold, the toner density control portion performs control in such a manner as to replenish a toner forcibly.

Further, the image forming apparatus of the present invention is characterized in that an absolute value of the second developing potential control range is smaller than an absolute value of the first developing potential control range.

Further, the image forming apparatus of the present invention is characterized in that the image density control portion, when the developing bias value after correction of the image density exceeds the first upper threshold, performs control in such a manner as to decrease a toner replenishment amount to be supplied to the toner storage portion, and when the developing bias value after correction of the image density exceeds the first lower threshold, performs control in such a manner as to increase the toner replenishment amount to be supplied to the toner storage portion.

Further, an image forming method of the present invention uses an image forming apparatus including a toner storage portion for storing a toner and a carrier; a developing portion for performing development using a dual-component developer including the toner and the carrier; a toner replenishing portion for replenishing the toner from the toner storage portion to the developing portion device; a toner density detecting portion for detecting a toner density of the developing portion; a photoreceptor drum for carrying a toner image visualized by the developing portion; a toner patch forming portion for forming a toner patch for detecting an image density on the photoreceptor drum; an image density detecting portion for detecting a density of the toner patch; and a storage portion for storing a density of a reference toner patch serving as a reference of an image density and a reference developing bias value to be applied to the developing portion, and is characterized in that an image density control step of comparing the density of the toner patch that is detected and the density of the reference toner patch to correct the image density; a toner density control step of controlling a developing bias value to be applied to the developing portion in such a manner as to fall within a first developing potential control range determined by a first upper threshold and a first lower threshold; a toner replenishing step of performing control to consume a toner forcibly, when a difference between the reference developing bias value and a developing bias value after correction of the image density exceeds the first upper threshold; and a toner consuming step of performing control to replenish a toner forcibly, when the difference between the reference developing bias value and the developing bias value after correction of the image density exceeds the second lower threshold, are included.

Further, the image forming method of the present invention is characterized in that an image density control repeating step of correcting the image density again after performing the control of toner replenishment or the control of toner consumption; a second toner density control step of performing control in such a manner that the developing bias after correction of the image density falls within a second developing potential control range determined by a second upper threshold and a second lower threshold; a second toner replenishing step of performing control in such a manner as to consume a toner forcibly, when the difference between the reference developing bias value and the developing bias value after correction of the image density exceeds the second upper threshold; and a second toner consuming step of performing control in such a manner as to replenish a toner forcibly, when the difference between the reference developing bias value and the developing bias value after correction of the image density exceeds the second lower threshold are included.

Further, an image forming program of the present invention causes a computer to execute an image forming method using an image forming apparatus including a toner storage portion for storing a toner and a carrier; a developing portion for performing development using a dual-component developer including the toner and the carrier; a toner replenishing portion for replenishing the toner from the toner storage portion to the developing portion; a toner density detecting portion for detecting a toner density of the developing portion; a photoreceptor drum for carrying a toner image visualized by the developing portion; a toner patch forming portion for forming a toner patch for detecting an image density on the photoreceptor drum; an image density detecting portion for detecting a density of the toner patch; and a storage portion for storing a density of a reference toner patch serving as a reference of an image density and a reference developing bias value to be applied to the developing portion, and is characterized in that an image density control step of comparing the density of the toner patch that is detected and the density of the reference toner patch to correct the image density; a toner density control step of controlling a developing bias value to be applied to the developing portion in such a manner as to fall within a first developing potential control range determined by a first upper threshold and a first lower threshold; a toner replenishing step of performing control in such a manner as to consume a toner forcibly, when a difference between the reference developing bias value and a developing bias value after correction of the image density exceeds the first upper threshold; and a toner consuming step of performing control in such a manner as to replenish a toner forcibly, when the difference between the reference developing bias value and the developing bias value after correction of the image density exceeds the second lower threshold are caused to be executed.

Further, the image forming program of the present invention is characterized in that an image density control repeating step of correcting the image density again after performing the control of toner replenishment or the control of toner consumption; a second toner density control step of performing control in such a manner that the developing bias value after correction of the image density falls within a second developing potential control range determined by a second upper threshold and a second lower threshold; a second toner replenishing step of performing control in such a manner as to consume a toner forcibly, when the difference between the reference developing bias value and the developing bias value after correction of the image density exceeds the second upper threshold; and a second toner consuming step of performing control in such a manner as to replenish a toner forcibly, when the difference between the reference developing bias value and the developing bias value after correction of the image density exceeds the second lower threshold are executed.

According to the present invention, the image forming apparatus includes a toner storage portion for storing a toner and a carrier; a developing portion for performing development using a dual-component developer including the toner and the carrier; a toner replenishing portion for replenishing the toner from the toner storage portion to the developing portion; a toner density detecting portion for detecting a toner density of the developing portion; a photoreceptor drum for carrying a toner image visualized by the developing portion; a toner patch forming portion for forming a toner patch for detecting an image density on the photoreceptor drum; an image density detecting portion for detecting a density of the toner patch; and a storage portion for storing a density of a reference toner patch serving as a reference of an image density and a reference developing bias value to be applied to the developing portion, which includes an image density control portion for comparing the density of the toner patch that is detected and the density of the reference toner patch to correct the image density; and a toner density control portion for controlling a developing bias value to be applied to the developing portion in such a manner as to fall within a first developing potential control range determined by a first upper threshold and a first lower threshold, in which when a difference between the reference developing bias value and a developing bias value after correction of the image density exceeds the first upper threshold, the toner density control portion performs control in such a manner as to consume a toner forcibly, and when the difference between the reference developing bias value and the developing bias value after correction of the image density exceeds the first lower threshold, the toner density control portion performs control in such a manner as to replenish a toner forcibly, which is hence markedly effective in shifting a toner density to an appropriate range and performing image forming with a stable toner density.

According to the present invention, the image density control portion of the image forming apparatus corrects the image density again after performing the control of toner replenishment or the control of toner consumption, the toner density control portion performs control in such a manner that the developing bias value after correction of the image density falls within a second developing potential control range determined by a second upper threshold and a second lower threshold, and the toner density control portion, when the difference between the reference developing bias value and the developing bias value after correction of the image density exceeds the second upper threshold, performs control in such a manner as to consume a toner forcibly, and when the difference between the reference developing bias value and the developing bias value after correction of the image density exceeds the second lower threshold, performs control in such a manner as to replenish a toner forcibly, which is hence markedly effective in performing image forming while keeping a more stable toner density over a long period of time.

According to the present invention, the image density control portion of the image forming apparatus, when the developing bias value after correction of the image density exceeds the first upper threshold, performs control in such a manner as to decrease a toner replenishment amount to be supplied to the toner storage portion, and when the developing bias value after correction of the image density exceeds the first lower threshold, performs control in such a manner as to increase the toner replenishment amount to be supplied to the toner storage portion, which is hence markedly effective in performing image forming with a stable toner density by increasing or decreasing a toner replenishment amount instantly even when the toner density largely falls out of an appropriate range.

According to the present invention, an image forming method uses an image forming apparatus including a toner storage portion for storing a toner and a carrier; a developing portion for performing development using a dual-component developer including the toner and the carrier; a toner replenishing portion for replenishing the toner from the toner storage portion to the developing portion; a toner density detecting portion for detecting a toner density of the developing portion; a photoreceptor drum for carrying a toner image visualized by the developing portion; a toner patch forming portion for forming a toner patch for detecting an image density on the photoreceptor drum; an image density detecting portion for detecting a density of the toner patch; and a storage portion for storing a density of a reference toner patch serving as a reference of an image density and a reference developing bias value to be applied to the developing portion, in which an image density control step of comparing the density of the toner patch that is detected and the density of the reference toner patch to correct the image density; a toner density control step of controlling a developing bias value to be applied to the developing portion in such a manner as to fall within a first developing potential control range determined by a first upper threshold and a first lower threshold; a toner replenishing step of performing control in such a manner as to consume a toner forcibly, when a difference between the reference developing bias value and a developing bias value after correction of the image density exceeds the first upper threshold; and a toner consuming step of performing control in such a manner as to replenish a toner forcibly, when the difference between the reference developing bias value and the developing bias value after correction of the image density exceeds the second lower threshold, which is hence markedly effective in shifting a toner density to an appropriate range and performing image forming with a stable toner density.

According to the present invention, the image forming method using the image forming apparatus includes an image density control repeating step of correcting the image density again after performing the control of toner replenishment or the control of toner consumption; a second toner density control step of performing control in such a manner that the developing bias value after correction of the image density falls within a second developing potential control range determined by a second upper threshold and a second lower threshold; a second toner replenishing step of performing control in such a manner as to consume a toner forcibly, when the difference between the reference developing bias value and the developing bias value after correction of the image density exceeds the second upper threshold; and a second toner consuming step of performing control in such a manner as to replenish a toner forcibly, when the difference between the reference developing bias value and the developing bias value after correction of the image density exceeds the second lower threshold, which is hence markedly effective in performing image forming while keeping a more stable toner density over a long period of time.

According to the present invention, an image forming program causes a computer to execute an image forming method using an image forming apparatus including a toner storage portion for storing a toner and a carrier; a developing portion for performing development using a dual-component developer including the toner and the carrier; a toner replenishing portion for replenishing the toner from the toner storage portion to the developing portion; a toner density detecting portion for detecting a toner density of the developing portion; a photoreceptor drum for carrying a toner image visualized by the developing portion; a toner patch forming portion for forming a toner patch for detecting an image density on the photoreceptor drum; an image density detecting portion for detecting a density of the toner patch; and a storage portion for storing a density of a reference toner patch serving as a reference of an image density and a reference developing bias value to be applied to the developing portion, in which an image density control step of comparing the density of the toner patch that is detected, and the density of the reference toner patch to correct the image density; and a toner density control step of controlling the developing bias value to be applied to the developing portion in such a manner as to fall within a first developing potential control range determined by a first upper threshold and a first lower threshold; a toner replenishing step of performing control in such a manner as to consume a toner forcibly, when a difference between the reference developing bias value and a developing bias value after correction of the image density exceeds the first upper threshold; and a toner consuming step of performing control in such a manner as to replenish a toner forcibly, when the difference between the reference developing bias value and the developing bias value after correction of the image density exceeds the second lower threshold are caused to be executed, which is hence markedly effective in shifting a toner density to an appropriate range and performing image forming with a stable toner density.

According to the present invention, the image forming program executes an image density control repeating step of correcting the image density again after performing the control of toner replenishment or the control of toner consumption; a second toner density control step of performing control in such a manner that the developing bias value after correction of the image density falls within a second developing potential control range determined by a second upper threshold and a second lower threshold; a second toner replenishing step of performing control in such a manner as to consume a toner forcibly, when the difference between the reference developing bias value and the developing bias value after correction of the image density exceeds the second upper threshold; and a second toner consuming step of performing control in such a manner as to replenish a toner forcibly, when the difference between the reference developing bias value and the developing bias value after correction of the image density exceeds the second lower threshold, which is hence markedly effective in performing image forming while keeping a more stable toner density over a long period of time.

DESCRIPTION OF THE PREFERRED EMBODIMENTS

Figure 1:
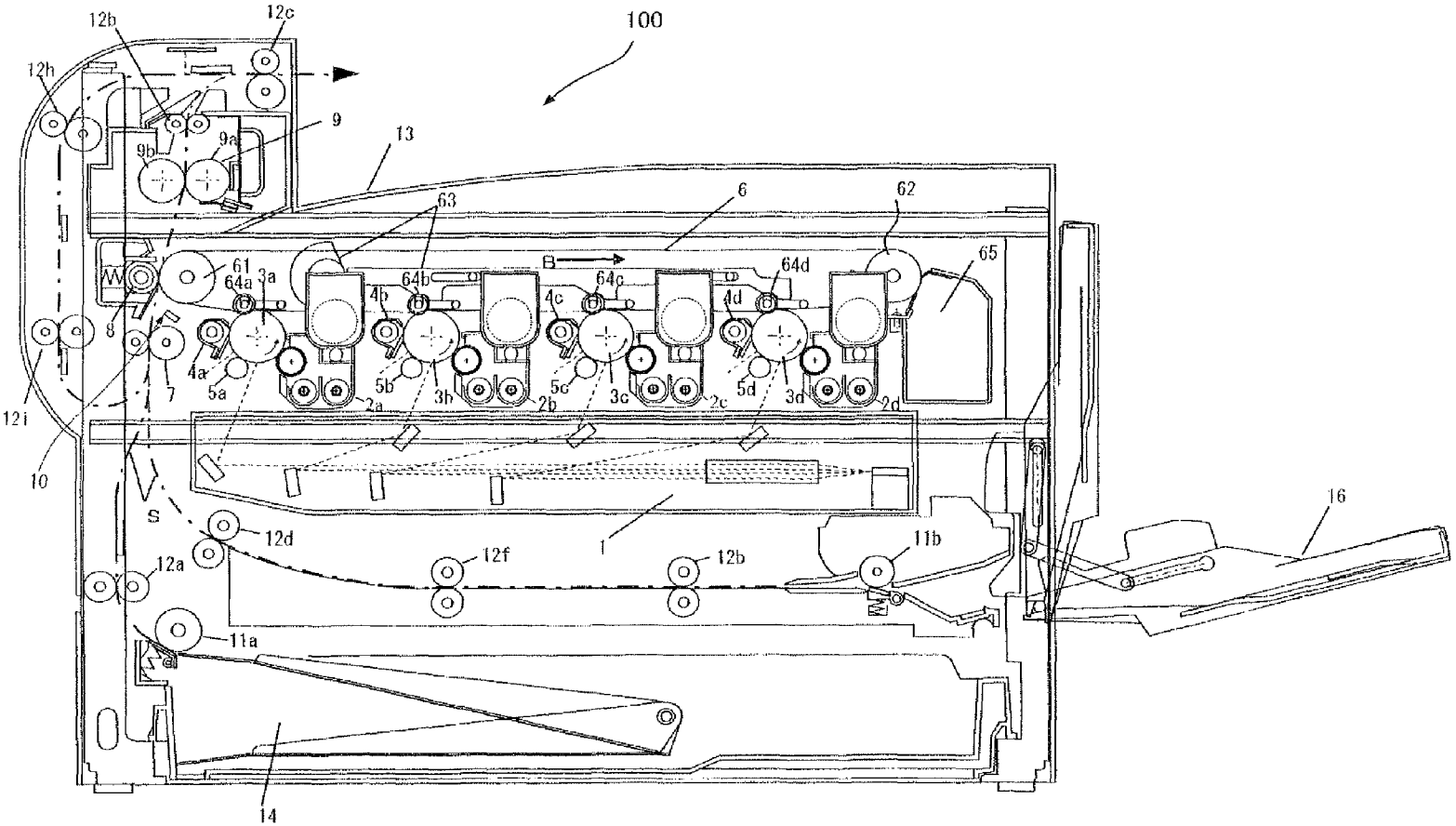
FIG. 1 is a schematic view showing a configuration of an image forming apparatus according to an embodiment of the present invention.

An image forming apparatus 100 according to the present embodiment will be described below. FIG. 1 is a schematic view showing a configuration of the image forming apparatus 100 according to the present embodiment.

As shown in FIG. 1, the image forming apparatus 100, forms a multi-color image and a monochrome image on a recording member (paper) based on image data externally transmitted through a communication network or image data input from an external storage device (not shown).

The image forming apparatus 100 is provided with an exposure unit 1, developing portions 2 (2*a*, 2*b*, 2*c*, 2*d*), photoreceptor drums 3 (3*a*, 3*b*, 3*c*, 3*d*), cleaner units (4*a*, 4*b*, 4*c*, 4*d*), chargers 5 (5*a*, 5*b*, 5*c*, 5*d*), an intermediate transfer belt 6, a registration roller 7, a transfer roller 8, a fixing unit 9, a paper feed tray 14, a control portion 10, a paper feed path S, and a paper output tray 13.

Image data in the image forming apparatus 100 corresponds to color images using respective colors of black (K), cyan (C), magenta (M), and yellow (Y). Accordingly, four sets of image stations each include the developing portions 2 (2*a*, 2*b*, 2*c*, 2*d*), the photoreceptor drums 3 (3*a*, 3*b*, 3*c*, 3*d*), the cleaner units 4 (4*a*, 4*b*, 4*c*, 4*d*), and the chargers 5 (5*a*, 5*b*, 5*c*, 5*d*) to provide four kinds of electrostatic latent images to be formed corresponding to the respective colors. In addition, a is associated with black, b is associated with cyan, c is associated with magenta, and d is associated with yellow, thereby constituting four image stations. Note that, a color image is formed using four colors in the present embodiment, however, multi-color image forming, for example, using six colors, and monochrome image forming are also applicable.

The exposure unit 1 is a laser scanning unit (LSU) using a laser diode in a laser light source. The exposure unit 1 exposes the outer peripheral surface of the photoreceptor drum 3 that has been uniformly charged by the charger 5 corresponding to input image data, so as to form an electrostatic latent image corresponding to the above-described input image data on the outer peripheral surface of the photoreceptor drum 3. Note that, a configuration using a writing head in which light emitting elements such as EL (Electro Luminescence) or LED (Light Emitting Diode) are arrayed in place of the laser diode may be employed.

The developing portion 2 visualizes the electrostatic latent image formed on each of the photoreceptor drums 3 with the toner of black (K), cyan (C), magenta (M), and yellow (Y). The developing portion 2 will be described below in detail.

The cleaner unit 4 is provided with a cleaning blade (not shown) which is arranged so as to be brought into contact (or slide contact) with the outer peripheral surface of the photoreceptor drum 3, and removes and collects a toner remaining on the surface of the photoreceptor drum 3 after the development and the transfer of the electrostatic latent image.

The photoreceptor drum 3 is arranged so that a part of its outer peripheral surface comes into contact with the surface of the intermediate transfer belt 6 while the charger 5 as an electric field generator, the developing portion 2 and the cleaner unit 4 are arranged close to the outer peripheral surface of the drum.

The charger 5 is a charging portion for uniformly charging the outer peripheral surface of the photoreceptor drum 3 to a predetermined potential. Note that, though in the present embodiment, a charger type charger is used as the charger 5, a roller type charger, a brush type charger or the like may be used in place of the charger type charger.

The intermediate transfer belt 6 is arranged above the photoreceptor drum 3 and is provided with the intermediate transfer belt 6, an intermediate transfer belt driving roller 61, an intermediate transfer belt driven roller 62, and an intermediate transfer belt cleaning unit 65. In, addition, the intermediate transfer belt 6 is supported around the intermediate transfer belt driving roller 61, the intermediate transfer belt driven roller 62, an intermediate transfer belt tensioning mechanism 63, and an intermediate transfer roller 64 with tension, and is rotationally driven in a direction of an arrow B in FIG. 1.

The intermediate transfer belt 6 is provided so as to be brought into contact with each of the photoreceptor drums 3. A color toner image (multi-color toner image) is formed on the intermediate transfer belt 6 by successively superimposing and transferring the toner image of respective colors formed on each of the photoreceptor drums 3 onto the intermediate transfer belt 6. Moreover, the intermediate transfer belt 6 is a belt member formed into an endless shape using a film of a thickness of around 100 μm to 150 μm. The intermediate transfer belt 6 mainly uses polyimide, polycarbonate, thermoplastic elastomer alloy or the like as a material.

The toner image formed on the photoreceptor drum 3 is transferred onto an intermediate transfer belt 60 by the intermediate transfer roller 64. The intermediate transfer roller 64 is rotatably supported at an intermediate transfer roller fitting portion (not shown) in the intermediate transfer belt tensioning mechanism 63 of the intermediate transfer belt 6, and applies a transfer bias for transferring the toner image formed on the photoreceptor drum 3 onto the intermediate transfer belt 60.

The intermediate transfer roller 64 is applied with a high-voltage transfer bias (a high voltage of a polarity (+) opposite to the charging polarity (−) of toner) in order to transfer the toner image. The intermediate transfer roller 64 is a roller having a metal (such as stainless steel) shaft of diameter 8 to 10 mm as a base, with the surface of which covered by a conductive elastic material, for example, such as Ethylene Propylene Diane Methylene Linkage (EPDM) or urethane foam. This conductive elastic material makes is possible to apply a high voltage uniformly to the intermediate transfer belt 6. Note that, though in the present embodiment, a roller-shaped transfer electrode is used, a brush-like transfer electrode or the like may be used instead.

In this manner, the electrostatic latent images of the respective color hues visualized on the photoreceptor drums 3 are layered on the intermediate transfer belt 6, forming the image corresponding to input image data. The layered toner image is conveyed by rotation of the intermediate transfer belt 6 to the position at which the transfer roller 8 is arranged. The transfer roller 8 is applied with a voltage (a high voltage of a polarity (+) opposite to the charging polarity (−) of toner) in order to transfer the toner image onto a recording member (paper). Moreover, the intermediate transfer belt 6 and the transfer roller 8 are pressed against each other with a predetermined nip pressure. In order for the transfer roller 8 to obtain the constant nip pressure, either the transfer roller 8 or the intermediate transfer belt driving roller 61 is formed of a hard material (such as metal) while the other is formed of a soft material such as an elastic roller (elastic rubber roller or foamed resin roller).

In addition, the toner adhering to the intermediate transfer belt 6 as the belt comes in contact with the photoreceptor drums 3 or the toner which has not been transferred by the transfer roller 8 onto the paper and remains on the intermediate transfer belt 6 causes contamination of color toners at the next operation, hence is removed and collected by an the intermediate transfer belt cleaning unit 65. The intermediate transfer belt cleaning unit 65 is provided with a cleaning blade (not shown) that is brought into contact with the intermediate transfer belt 6 as a cleaning member, and the intermediate transfer belt 6 is supported from its interior side by the intermediate transfer belt driven roller 62, at the area where the cleaning blade is brought into contact with the intermediate transfer belt 6.

The paper feed tray 14 is a tray for stacking recording medium (paper) to be used for image forming and is provided under the exposure unit 1. In addition, the paper output tray 13 provided at the top of the image forming apparatus 100 is a tray in which printed paper is placed facedown.

The image forming apparatus 100 is also provide with a paper feed path S that extends approximately vertically to convey the paper from the paper feed tray 14 to the paper output tray 13 by way of the transfer roller 8 and the fixing unit 9. In addition, arranged near the paper feed path S from the paper feed tray 14 to the paper output tray 13 are pickup rollers 11 (11*a*, 11*b*), the registration roller 7, the transfer roller 8, a heating roller 9*a* and a pressing roller 9*b* of the fixing unit 9, and feed rollers 12 (12*a* to 12*i*).

The feed roller 12 is a small roller for promoting and supporting conveyance of the recording medium (paper), and a plurality of feed rollers are provided along the paper feed path S. The pickup roller 11*a* is provided at an end portion of the paper feed tray 14 and is a draw-in roller that supplies paper one by one from the paper feed tray 14 to the paper feed path S.

The registration roller 7 is a roller that temporarily holds the paper that has been conveyed in the paper feed path S. The control portion 10 rotates the registration roller 7 again to thereby time the moment of next conveyance by temporarily stopping the paper conveyed along the paper feed path S at the predetermined position. The paper is conveyed to a transfer portion having the transfer roller 8 so that the position of the leading edge of the paper coincides with the position of the leading edge of the image formed on the outer peripheral of the photoreceptor drum 3.

The fixing unit 9 is provided with the heating roller 9*a* and the pressing roller 9*b*, and the heating roller 9*a* and the pressing roller 9*b* are rotated, with the paper lying therebetween. Moreover, the heating roller 9*a* is set so as to have a predetermined fixing temperature by the control portion on the basis of a signal from a not-shown temperature detector. The heating roller 9*a* thermally presses the paper with the pressing roller 9*b*, so that the toner images of multiple colors transferred onto the paper are melted, mixed and brought into pressure-contact, and thermally fixed onto the paper.

Note that, it is configured such that the paper with the toner images of multiple colors fixed thereon is conveyed by the feed rollers 12*b* and 12*c* to an inversion paper output path of the paper feed path S and output onto the paper output tray 13 in an inverted state (with the toner image of multiple colors placed facedown).

Figure 2:
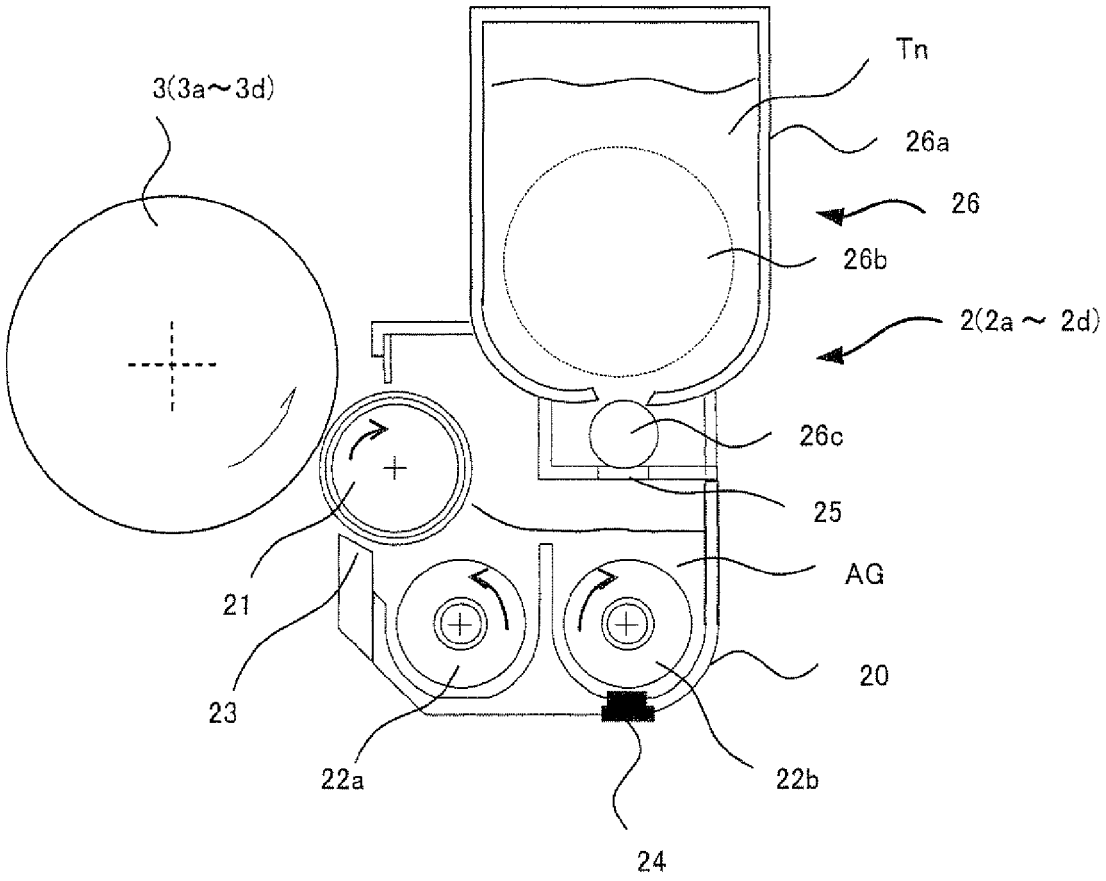
FIG. 2 is a schematic view showing a configuration of a developing portion according to the present embodiment.

Next, detailed description will be given for the developing portion 2 that supplies a toner to an electrostatic latent image formed on the surface (outer peripheral surface) of the photoreceptor drum 3 to visualize the electrostatic latent image as shown in FIG. 2.

The developing portion 2 visualizes an electrostatic latent image formed on the photoreceptor drum 3 which is an example of an electrostatic latent image carrier with a toner. The developing portion 2 has a developing container 20 for containing a dual-component developer AG including a toner and a carrier, a developing roller 21 which is arranged so as to be close to the photoreceptor drum 3 in an opposed state for supplying the dual-component developer AG in the developing container 20 to the photoreceptor drum 3, two conveying screws 22*a* and 22*b* for conveying the dual-component developer AG in the developing container 20 toward the developing roller 21 while agitating, and a doctor blade 23 for regulating the amount of the developer to the developing roller 21.

The developing container 20 is formed with an opening 25 which is opened and closed for replenishing the toner into the developing container 20 at an upper part thereof. A toner replenishing device 26 for newly supplying the toner is arranged above the opening 25.

Figure 3:
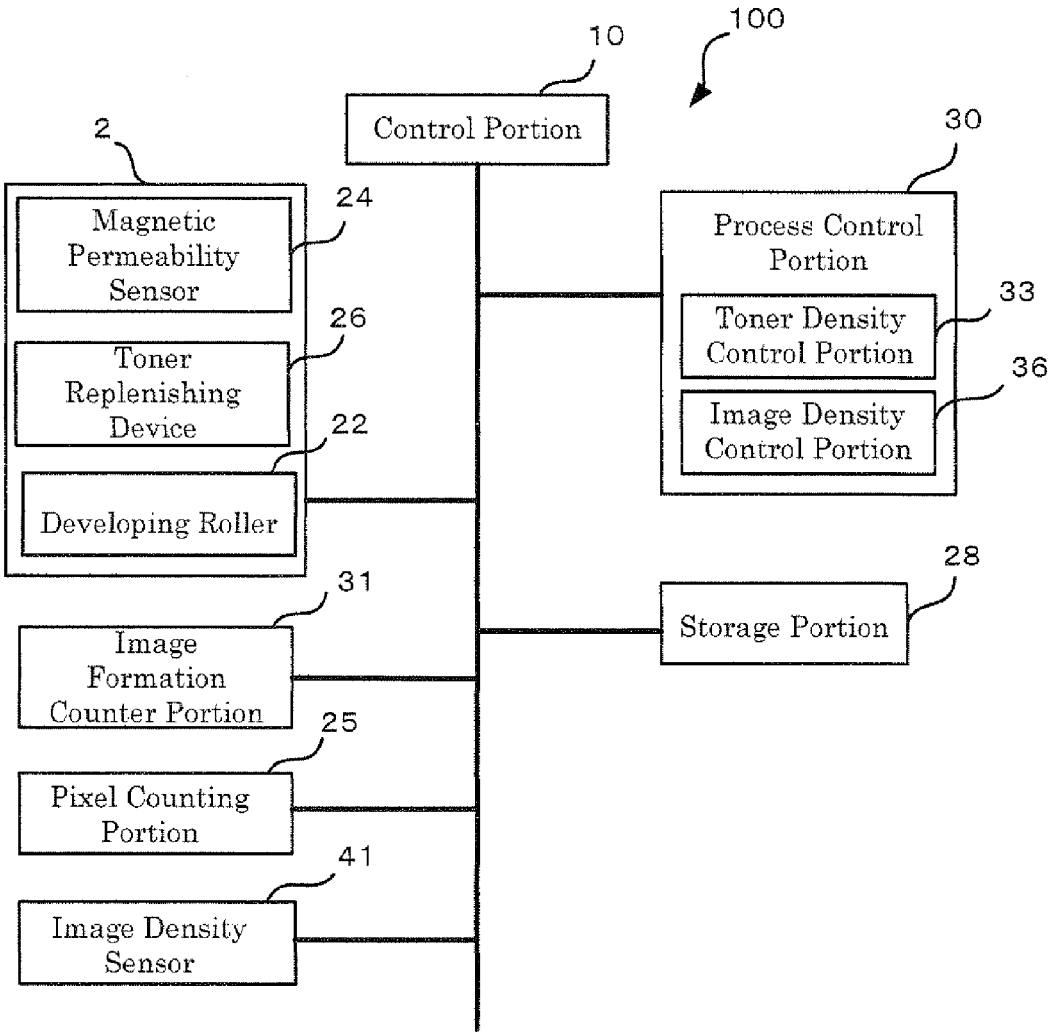
FIG. 3 is a block diagram showing a configuration of a control portion of the image forming apparatus according to the present embodiment.

The toner replenishing device 26 is provided with a toner storage container 26*a* for storing a toner Tn, a toner agitating member 26*b* for agitating the toner Tn stored in the toner storage container 26*a*, and a toner replenishing roller 26*c* for supplying the toner in the toner storage container 26*a* while agitating. The toner replenishing device 26 replenishes the toner Tn to the developing portion 2 through the opening 25 based on an instruction from a process control portion 30 as shown in FIG. 3.

In addition, a magnetic permeability sensor 24 is provided below the opening 25 in the bottom surface of the developing container 20. The magnetic permeability sensor 24 detects a density (mixing ratio) and a remaining amount of the toner and the carrier in the dual-component developer AG. When the toner density is high, the amount of the toner adhering to the magnetic carrier increases and the amount of a magnetic material in a unit volume of the developer decreases, so that the magnetic permeability sensor 24 detects a low voltage level. Moreover, whether or not the toner falls is detected based on the amount of change in output of the magnetic permeability sensor 24 when the toner is replenished.

The control portion 10 is able to monitor a voltage output level of the magnetic permeability sensor 24 to detect whether or not the toner falls based on the amount of change in the voltage output level of the magnetic permeability sensor 24.

Next, description will be given for image density control and toner density control according to the present embodiment. FIG. 3 is a block diagram of the image forming apparatus 100 according to the present embodiment.

As shown in FIG. 3, the image forming apparatus 100 is provided with the control portion 10, the process control portion 30, an image formation counter portion 31, a pixel counting portion 25, an image density sensor 41, and a storage portion 28. Each component and operations of the image forming apparatus 100 will be described below.

The control portion 10 controls operations in the image forming apparatus 100. Moreover, the control portion 10 is comprised of a micro-computer, a ROM (Read Only Memory) which stores a control program indicating the procedure of processing executed by the micro-computer, a RAM (Random Access Memory) which provides a working area, an EEPROM (Electronically Erasable Programmable ROM) non-volatile memory which temporarily stores a cumulative toner replenishing time that is calculated, an input circuit which is a circuit for inputting signals from the magnetic permeability sensor 24 and a switch (not shown) and includes an input buffer and an A/D conversion circuit, an output circuit which includes a driver for driving a motor and a solenoid or a lamp etc., and the like. Note that, these storage units are collectively referred to as the storage portion 28.

The storage portion 28 stores a reference developing bias value serving as a reference of a developing bias. The reference developing bias value serves as a reference when a toner density control portion 33 controls correction of the toner density based on the developing bias value. The storage portion 28 also stores a density value of a reference toner patch serving as a reference of an image density. The density value of the reference toner patch serves as a reference when an image density control portion 36 controls correction of the toner density based on the image density.

In the image forming apparatus 100, in order to obtain the constant toner density and image output without being affected by a temporal change of the photoreceptor drum and the developer with time, various processing conditions are adjusted for the operation. The adjustment is referred to as process control. To be more specific, the adjustment is carried out for a charged potential, an exposure amount, a correction quantity of a toner density, a developing bias value, a transfer voltage value, a fixing temperature, and the like.

The process control portion 30 carries out the above-described process control to make adjustment for obtaining the constant toner density and image output. The process control portion 30 is provided with the toner density control portion 33 and the image density control portion 36.

The toner density control portion 33 controls the developing bias to be applied between the developing roller 21 and the photoreceptor drum 3. The image density control portion 36 determines the toner replenishment amount to be supplied to the toner replenishing device 26 based on a developing bias difference and replenishes the toner to control correction of the toner density. The toner density control portion 33 will be described below in detail.

The image density control portion 36 of the process control portion 30 forms a predetermined intermediate tone toner patch (solid image) on the photoreceptor drum 3, the intermediate transfer belt 6, or the like, and a quantity of reflection light from the toner patch is read by a scanning device of the image density sensor 41, to perform intermediate tone gamma correction processing. Further, the image density control portion 36 controls the toner density with the correction of the image density.

Specifically, in the intermediate tone gamma correction processing, calibration of the image density sensor 41 is carried out, and a charged potential, a quantity of light, and an application voltage in creating the toner patch (solid image) are set, to correct the condition for forming the toner patch. Then, the predetermined intermediate tone toner patch is formed on the photoreceptor drum 3, the intermediate transfer belt 6, or the like. Subsequently, the quantity of reflection light from the toner patch is read by the image density sensor 41, and the output value of the image density sensor 41 based on the read toner patch is compared with a reference target value stored in the storage portion 28, so as to calculate a correction quantity in the density of the printing image. A conversion table (intermediate tone gamma correction table) that can be used for gamma correction of brightness or color in displaying an image is modified according to the correction quantity thus calculated. This makes it possible to obtain constant intermediate tone gamma characteristics and stabilize the density of the printing image. Note that, the storage portion 28 records the conversion table (intermediate tone gamma correction table) preliminarily.

The image formation counter portion 31 is a measuring portion for counting the total number of times of image forming operations. The counted total number of times of image forming operations is notified to the process control portion 30. The process control portion 30 corrects the image forming operations in view of the total number of times.

The magnetic permeability sensor 24 detects the toner density of the developing container 20 of the developing portion 2 and notifies the toner density control portion 33 and the image density control portion 36 in the process control portion 30 of the detected toner density.

The pixel counting portion 25 accumulates pixel counts of an image of a document that is input. The pixel counting portion 25 calculates a rate of a printing pixel (a pixel formed by the toner) to all pixels of the document image, based on any information of the document image, including printing density information, a printing pixel area or a solid rate (a rate of a black pixel to all pixels in a page of the document) of the input document image. That is, the pixel counting portion 25 counts pixels to obtain a rate to all pixels of the image.

The image density control portion 36 of the process control portion 30 obtains printing rate information of the document image from the pixel counting portion 25 and calculates a toner consumption consumed in a printing operation. The image density control portion 36 also transmits to the process control portion 30 a request signal for instructing the toner replenishing device 26 of the developing portion 2 to replenish the toner in accordance with the calculated toner consumption. In this manner, with the correction based on the image density, the toner density of the developing container 20 of the developing portion 2 is controlled to be constant.

The toner density control portion 33 of the process control portion 30 corrects a control parameter value of the developing bias (developing bias value) in the process control and controls the developing bias to be applied to the developing portion. In order to determine whether or not the amount of the toner supplied is appropriate, the toner density control portion 33 also performs feedback control based on a difference between the developing bias value in correcting the image density and a reference developing bias value stored in the storage portion 28.

Specifically, when the difference between the developing bias value after the correction of the image density and the reference developing bias becomes larger than a prescribed value to the plus side, the toner density control portion 33 controls in such a manner as to consume the toner forcibly. Further, after the forcible toner consumption, the image density control portion 36 performs an operation of correcting the image density again. The toner density control portion 33 confirms that the difference between the developing bias value after the correction of the image density described above and the reference developing bias falls within a prescribed range (hereinafter, referred to as a first developing potential control range). Note that, the first developing potential control range is determined by a first upper threshold and a first lower threshold that are set preliminarily.

In the present embodiment, the reference developing bias value is set to −300 V, and the first upper threshold is by 100 V (voltage difference of 100 V) to the plus side and the first lower threshold is by 150 V to the minus side (voltage difference of 150) with the reference developing bias value as a center. That is, an absolute value of 250 V is set as the first developing potential control range.

When the voltage difference between the developing bias value after the correction of the image density and the reference developing bias value exceeds the first upper threshold (voltage difference of 100 V), the toner density control portion 33 controls to correct the toner density by correction based on the developing bias.

Specifically, when the voltage difference between the developing bias value after the correction of the image density and the reference developing bias increases by 100 V or more to the plus direction with the reference developing bias value (−300 V) as a center, the toner density control portion 33 judges that the toner density becomes high, and performs the operation of consuming the toner in the developer forcibly without starting the printing operation again.

To be more specific, in an image station (image forming portion) in which voltage difference between the developing bias value after the correction of the image density and the reference developing bias is 100 V or more, the amount of the toner, by which the solid image is able to be printed on the three sheets of entire paper having an A-4 size is used, and a toner image (toner patch) is visualized on the photoreceptor drum 3, and the toner is collected by the intermediate transfer belt cleaning unit 65 without transferring onto the intermediate transfer belt 6. Accordingly, the toner in the developer is consumed forcibly and the toner density is kept at an appropriate constant density, thus making it possible to realize normal image forming.

After the toner consumption based on the voltage difference between the developing bias value after the correction of the image density and the reference developing bias, the image density control portion 36 controls to correct the image density again. The toner density control portion 33 confirms that the voltage difference between the developing bias value after the correction of the image density with the toner consumption and the reference developing bias falls within the first developing potential control range.

On the other hand, when the voltage difference between the developing bias value after the correction of the image density and the reference developing bias decreases by 150 V or more to the minus direction with the reference developing bias value (−300 V) as a center, the toner density control portion 33 judges that the toner density becomes low, and performs the operation of replenishing the toner to the developing portion forcibly without starting the printing operation again.

To be more specific, in an image station (image forming portion) in which voltage difference between the developing bias value after the correction of the image density and the reference developing bias is 150 V or more, the amount of the toner, by which the solid image is able to be printed on three sheets of entire paper having an A-4 size is supplied from the toner replenishing device 26 to the developing container 20 of the developing portion 2. Accordingly, the toner is replenished to the developer forcibly and the toner density is kept at an appropriate constant density, thus making it possible to realize normal image forming.

After the toner supply based on the voltage difference between the developing bias value after the correction of the image density and the reference developing bias, the image density control portion 36 controls to correct the image density again. The toner density control portion 33 confirms that the voltage difference between the developing bias value after the correction of the toner density with the toner supply and the reference developing bias falls within the first developing potential control range.

Accordingly, even when due to a change of an operational environment, an influence of a remaining amount of the toner in the toner replenishing device 26 etc., or degradation of the developer with time, a balance between the toner supply amount and the actual toner consumption breaks and the toner replenishment amount per unit of time to be supplied is larger or smaller than an assumed amount, it is possible to control to keep the appropriate toner density.

Next, description will be given for control of correction of the toner density after the toner consumption operation or the toner supply operation based on the voltage difference between the developing bias value after the correction of the image density and the reference developing bias.

In the correction of the toner density based on one time of the toner consumption operation or the toner supply operation described above, there is a case where the toner density can not be sufficiently appropriate. In this case, by repeating the correction of the image density with the image forming operation continuously, the developing bias value instantly exceeds the first developing potential control range. Therefore, without lapse of time, the operation is shifted again to the forcible toner consumption operation or the forcible toner supply operation, thus waste time is spent while completing the image forming operation.

In the present embodiment, in view of the above, after the toner consumption operation or the toner supply operation based on the voltage difference between the developing bias value after the correction of the image density and the reference developing bias described above, a second developing potential control range is provided to control correction of the toner density based on the second developing potential control range. The second developing potential control range is determined by a second upper threshold and a second lower threshold that are set preliminarily.

Figure 4A:
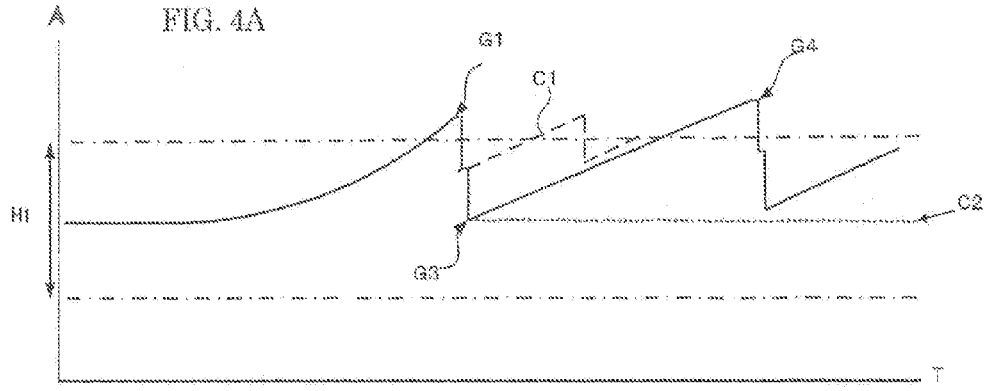
FIG. 4A shows an example of a diagram showing a relation between an increase of a toner density and the number of printing copies in the image forming apparatus according to the present embodiment.
Figure 4B:
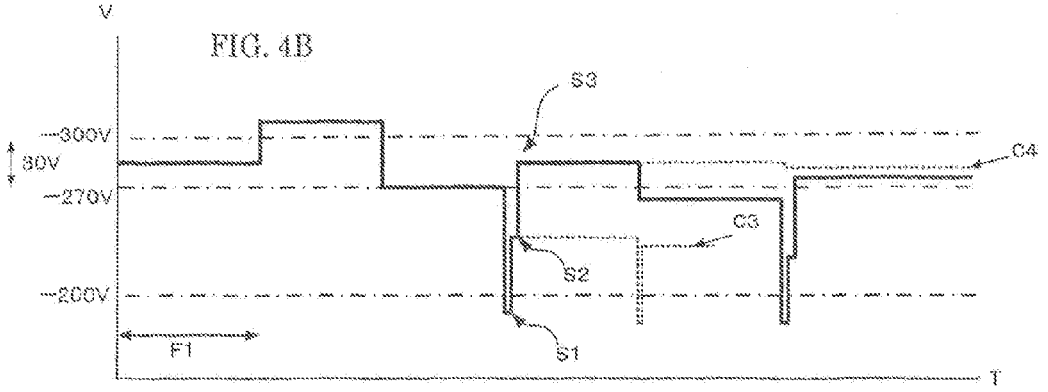
FIG. 4B shows an example of a diagram showing a relation between a developing bias and the number of printing copies in the image forming apparatus according to the present embodiment.
Figure 5A:
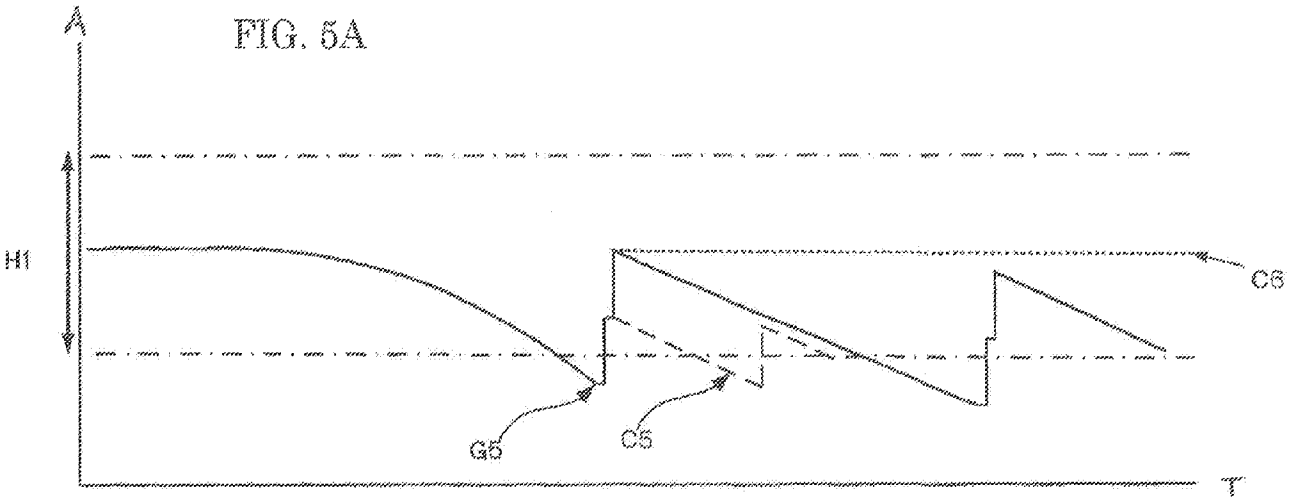
FIG. 5A shows an example of a diagram showing a relation between a decrease of a toner density and the number of printing copies in the image forming apparatus according to the present embodiment.
Figure 5B:
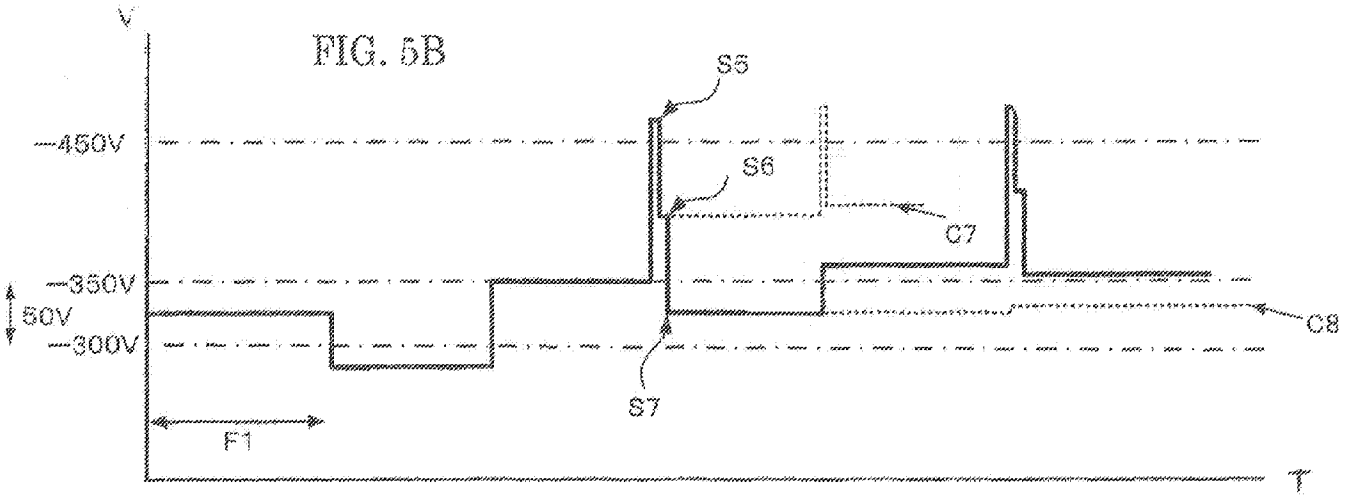
FIG. 5B shows an example of a diagram showing a relation between a developing bias and the number of printing copies in the image forming apparatus according to the present embodiment.
Figure 6:
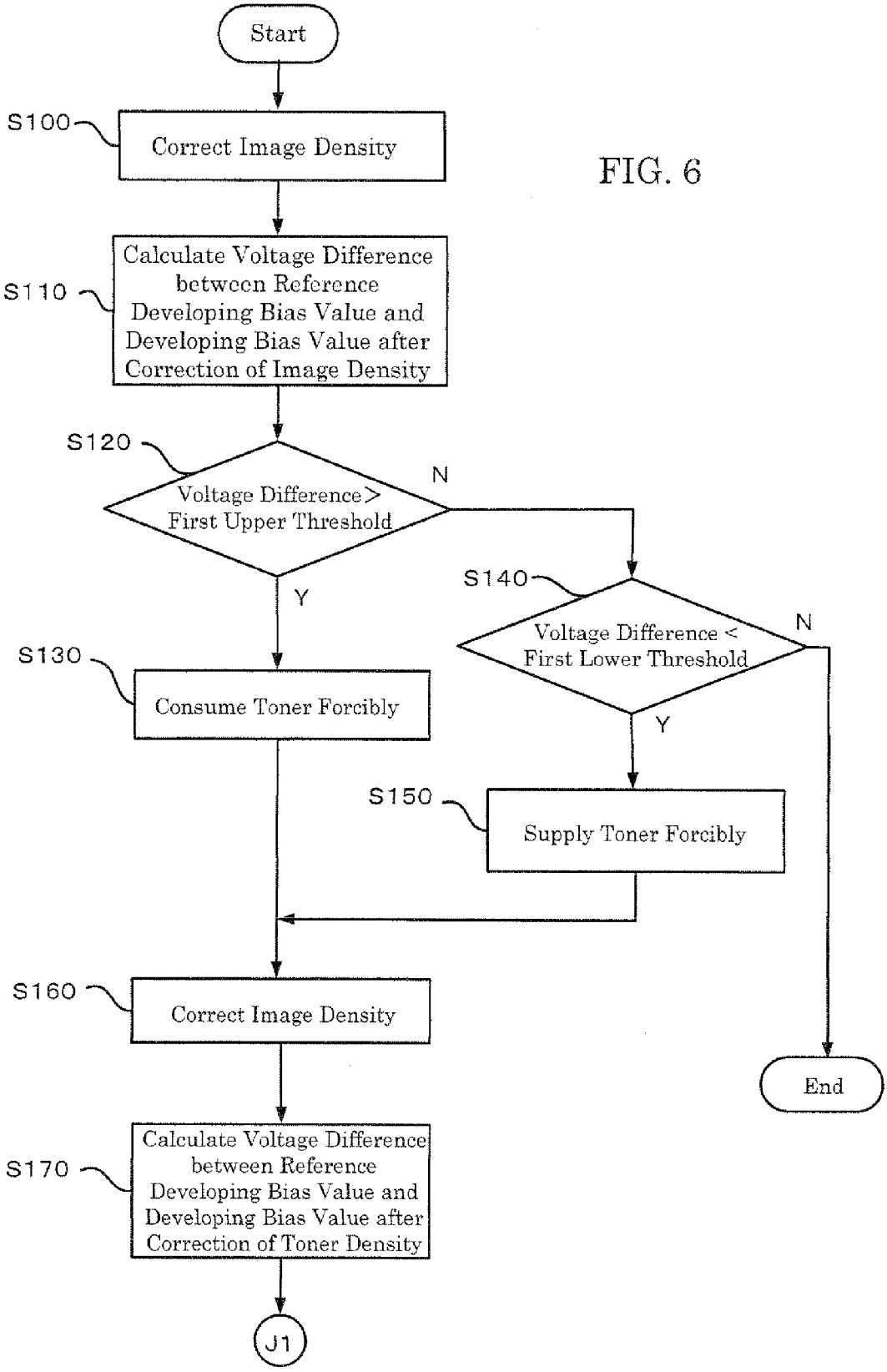
FIG. 6 is a flowchart showing first half processing for controlling a toner density in the image forming apparatus according to the present embodiment.

As shown in FIG. 4B and FIG. 5B, the reference developing bias values is set to −300 V, and the second upper threshold is by 30 V (voltage difference of 30 V) to the plus side and the second lower threshold is by 50 V (voltage difference of 50) to the minus side with the reference developing bias value as a center. An absolute value of 80 V is set as the second developing potential control range.

To be more specific, after the toner consumption operation or the toner supply operation based on the voltage difference between the developing bias value after the correction of the image density and the reference developing bias, the toner density control portion 33 confirms that the voltage difference between the developing bias value after the correction of the toner density with the toner consumption and the reference developing bias, or the voltage difference between the developing bias value after the correction of the toner density with the toner supply and the reference developing bias falls within the second developing potential control range.

When the voltage difference between the developing bias value after the correction of the toner density with the toner consumption and the reference developing bias becomes larger than the second upper threshold (voltage difference of 30 V) to the plus side, the toner density control portion 33 controls in such a manner as to consume the toner forcibly. On the other hand, when the voltage difference between the developing bias value after the correction of the toner density with the toner supply and the reference developing bias becomes larger than the second lower threshold (voltage difference of 50 V) to the minus side, the toner density control portion 33 controls in such a manner as to supply the toner forcibly.

In this manner, by controlling the correction of the toner density based on the second developing potential control range, the voltage difference between the developing bias value after the correction of the toner density and the reference developing bias is able to take a value approximate to the reference value that is set preliminarily and it is possible to control to have a stable toner density value over a long period of time.

Next, description will be given for control to change the toner supply amount when the voltage difference falls out of the first developing potential control range after the correction of the image density.

While a balance between the toner supply amount to the developer in the developing portion 2 and the toner consumption breaks and a discrepancy occurs between the actual toner consumption and the toner supply amount, when the printing operation is performed continuously, the voltage difference between the developing bias value after the correction of the toner density and the reference developing bias eventually exceeds the first developing potential control range and the toner density falls out of the appropriate range to deteriorate image quality of a printing image.

Thus, when the voltage difference between the developing bias value after the correction of the toner density by the tone density control portion 33 and the reference developing bias exceeds the first developing potential control range after the image density control portion 36 corrects the image density, the toner supply amount to be supplied to the developing container 20 of the developing portion 2 is changed.

For example, when the developing bias value after the correction of the image density exceeds the first lower threshold (when exceeding −450 V), the toner density becomes low. Therefore, the toner density control portion 33 controls in such a manner as to increase the toner supply amount. On the other hand, when the developing bias value after the correction of the image density exceeds the first upper threshold (when exceeding −200 V), the toner density becomes high. Thus, the toner density control portion 33 controls in such a manner as to decrease the toner supply amount.

In this manner, when the developing bias value after the correction of the image density exceeds the first developing potential control range, the toner supply amount is controlled in such a manner as to increase or decrease, so that it is possible to keep a more stable toner density over a long period of time and to prevent that the toner density falls out of the appropriate range and image quality of a printing image is deteriorated, after the toner consumption operation or the toner supply operation described above.

Next, description will be given for control of the toner density based on the first and second developing potential control ranges with reference to FIG. 4A and FIG. 4B or FIG. 5A and FIG. 5B.

FIG. 4A shows an example of a diagram showing a relation between an increase of a toner density and the number of printing copies with respect to the image forming apparatus 100. FIG. 4B shows an example of a diagram showing a relation between a developing bias value and the number of printing copies with respect to the image forming apparatus 100. FIG. 5A shows an example of a diagram showing a relation between a decrease of a toner density and the number of printing copies with respect to the image forming apparatus 100. FIG. 5B shows an example of a diagram showing a relation between a developing bias and the number of printing copies with respect to the image forming apparatus 100.

FIG. 4A shows a relation between a toner density A (ordinate) in a developer and the number of printing copies T (abscissa) in a case where the toner density gradually increases as the number of printing copies increases. A range H1 shown by an arrow in FIG. 4A indicates an appropriate range of the toner density. When the toner supply amount to be supplied to the developing container 20 of the developing portion 2 increases, the toner density increases as represented by dotted line C2 in FIG. 4A, and the developing bias value also increases as represented by dotted line C4 in FIG. 4B.

In FIG. 4A, as the number of printing copies T increases, the toner density increases and the toner density exceeds the appropriate toner density range H1 at a point G1.

In FIG. 4B, the reference developing bias value is set to −300 V and the first upper threshold is by 100 V (voltage difference of 100 V) to the plus side with the reference developing bias value as a center. The second upper threshold is set to be by 30 V (voltage difference of 30 V) to the plus side. Moreover, an image density correction interval F1 is carried out based on a condition that is set preliminarily. For example, it is assumed that various conditions are able to be set, such as for each prescribed number of printing copies, for each lapse of a given time or change of an operational environment.

At a point S1 in FIG. 4B, the voltage difference between the developing bias value after the correction of the image density and the reference developing bias value exceeds the first upper threshold (voltage difference of 100V). The toner density control portion 33 thus judges that the toner density falls out of the appropriate toner density range H1 to be high, and performs the operation of consuming the toner in the developer forcibly without starting the printing operation again and controls to correct the toner density. The toner density is corrected to be within the appropriate toner density range H1.

After the toner consumption operation based on the voltage difference between the developing bias value after the correction of the image density and the reference developing bias, the toner density control portion 33 confirms again that the voltage difference between the developing bias value after the correction of the toner density with the toner consumption and the reference developing bias falls within the second developing potential control range.

When it is impossible to obtain the sufficiently appropriate toner density by correcting the toner density based on the toner consumption operation once as described above, as represented by dotted line C1 in FIG. 4A and dotted line C3 in FIG. 4B, the operation is shifted again to the forcible toner consumption operation or the forcible toner supply operation.

Accordingly, when the developing bias value after the correction of the toner density with the toner consumption falls out of the second developing potential control range, that is, is positioned by 30 V or more to the plus side compared to the second upper threshold (voltage difference of 30 V) (S2 in FIG. 4B), the toner density control portion 33 controls to correct the toner density based on the second developing potential control range again after the image density is corrected by the image density control portion 36.

When the control is carried out to correct the toner density based on the second developing potential control range, the developing bias value that has been corrected again decreases to a point S3 in FIG. 4B. As a result, the toner density decreases to a point shown by G3 in FIG. 4A, thus obtaining a more stable state.

Similarly, the toner density increases as the number of printing copies increases, and the toner density exceeds the appropriate toner density range H1 again at a point G4 in FIG. 4A. The toner density control portion 33 repeats the correction of the toner density as described above to control the correction.

FIG. 5A shows a relation between a toner density A (ordinate) in a developer and the number of printing copies T (abscissa) in a case where the toner density gradually decreases as the number of printing copies increases. A range H1 shown by an arrow in FIG. 5A indicates an appropriate range of the toner density. When the toner supply amount to be supplied to the developing container 20 of the developing portion 2 decreases, the toner density decreases as represented by dotted line C6 in FIG. 5A, and the developing bias value also decreases as represented by dotted line CB in FIG. 5B.

In FIG. 5A, as the number of printing copies T increases, the toner density decreases, and the toner density exceeds the appropriate toner density range H1 at a point G5.

In FIG. 5B, the reference developing bias value is set to −300 V and the first lower threshold is by 150 V (voltage difference of 150 V) to the minus side with the reference developing bias value as a center. The second lower threshold is set to be by 50 V (voltage difference of 50 V) to the minus side. Moreover, the image density correction interval F1 is set based on a condition that is set preliminarily, including, for example, various conditions such as for each prescribed number of printing copies, for each lapse of a given time or change of an operational environment.

At a point S5 in FIG. 5B, the voltage difference between the developing bias value after the correction of the image density and the reference developing bias value exceeds the first lower threshold (voltage difference of 150 V). The toner density control portion 33 thus judges that the toner density falls out of the appropriate toner density range H1 to be low, and performs the operation of supplying the toner in the developer forcibly without starting the printing operation again and controls to correct the toner density. The toner density is corrected to be within the appropriate toner density range H1.

After the toner supply operation based on the voltage difference between the developing bias value after the correction of the image density and the reference developing bias, the toner density control portion 33 confirms again that the voltage difference between the developing bias value after the correction of the toner density with the toner supply and the reference developing bias falls within the second developing potential control range.

When it is impossible to obtain the sufficiently appropriate toner density by correcting the toner density based on the toner supply operation once as described above, as represented by dotted line C5 in FIG. 5A and dotted line C7 in FIG. 5B, the operation is shifted again to the forcible toner consumption operation or the forcible toner supply operation.

Accordingly, when the developing bias value after the correction of the toner density with the toner consumption falls out of the second developing potential control range, that is, is positioned by 50 V or more to the minus side compared to the second lower threshold (voltage difference of 50 V) (S6 in FIG. 5B), the toner density control portion 33 controls to correct the toner density based on the second developing potential control range again after the image density is corrected by the image density control portion 36.

When the control is carried out to correct the toner density based on the second developing potential control range, the developing bias value that has been corrected again increases to a point S7 in FIG. 5G. As a result, the toner density increases to a point shown by G5 in FIG. 5A, thus obtaining a more stable state.

Figure 7:
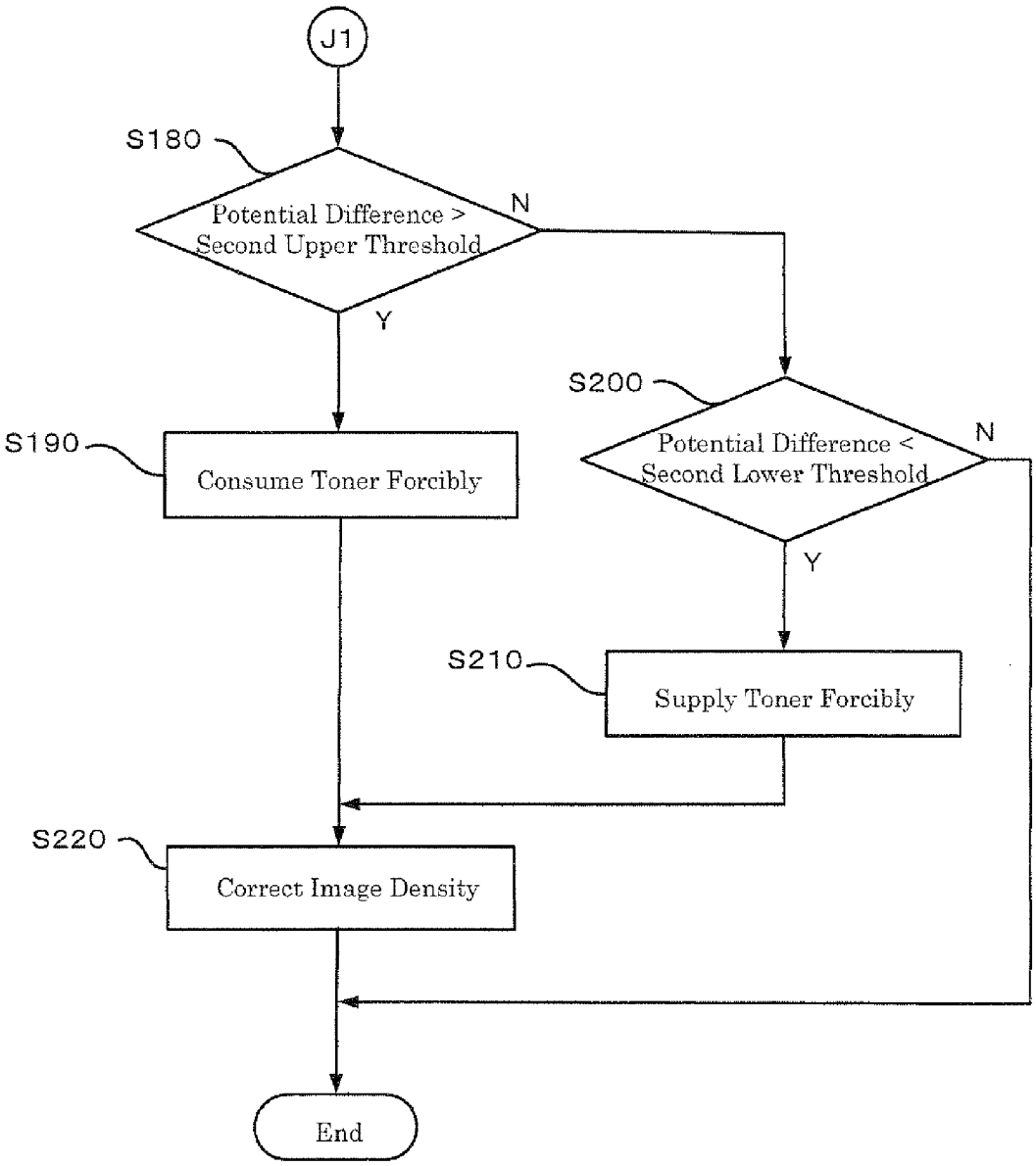
FIG. 7 is a flowchart showing last half processing for controlling a toner density in the image forming apparatus according to the present embodiment.

Next, description will be given for the control to correct a toner density by the toner density control portion 33 according to the present embodiment. FIG. 7 is a flowchart showing processing for controlling a toner density the image forming apparatus 100.

The image density control portion 36 performs the operation, of correcting the image density (step 100). The toner density control portion 33 then calculates the voltage difference between the developing bias value after the correction of the image density and the reference developing bias value (step 110).

When the voltage difference between the developing bias value after the correction of the image density and the reference developing bias value exceeds the first upper threshold (voltage difference of 100 V) (Y at step 120), the toner density control portion 33 judges that the toner density becomes high, and performs the operation of consuming the toner in the developer forcibly without starting the printing operation again (step 130).

When the voltage difference between the developing bias value after the correction of the image density and the reference developing bias value does not exceed the first upper threshold (voltage difference of 100 V) (N at step 120), it is judged whether or not the voltage difference between the developing bias value after the correction of the image density and the reference developing bias value exceeds the first lower threshold (voltage difference of 150 V) (step 140).

When the voltage difference between the developing bias value after the correction of the image density and the reference developing bias value exceeds the first lower threshold (voltage difference of 150 V) to be in the minus side (Y at step 140), the toner density control portion 33 judges that the toner density becomes low, and performs the operation of supplying the toner in the developer forcibly without starting the printing operation again (step 150).

It is confirmed that the voltage difference between the developing bias value after the correction of the toner density with the toner consumption or the toner supply and the reference developing bias falls within the first developing potential control range. After the toner consumption operation or the toner supply operation, the image density control portion 36 performs the operation of correcting the image density again (step 160).

The toner density control portion 33 then calculates the voltage difference between the developing bias value after the correction of the toner density and the reference developing bias value (step 170).

When the voltage difference between the developing bias value after the correction of the toner density and the reference developing bias value exceeds the second upper threshold (voltage difference of 30 V) (Y at step 180), the toner density control portion 33 judges that the toner density becomes high, and performs the operation of consuming the toner in the developer forcibly without starting the printing operation again (step 190).

When the voltage difference between the developing bias value after the correction of the toner density and the reference developing bias value does not exceed the second upper threshold (voltage difference of 30 V) (N at step 180), it is judged whether or not the voltage difference between the developing bias value after the correction of the toner density and the reference developing bias value exceeds the second lower threshold (voltage difference of 50 V) (step 200).

When the voltage difference between the developing bias value after the correction of the toner density and the reference developing bias value exceeds the second lower threshold (voltage difference of 50 V) to be in the minus side (Y at step 200), the toner density control portion 33 judges that the toner density becomes low, and performs the operation of supplying the toner in the developer forcibly without starting the printing operation again (step 210).

It is confirmed that the voltage difference between the developing bias value after the correction of the toner density with the toner consumption or the toner supply and the reference developing bias falls within the second developing potential control range. After the toner consumption operation or the toner supply operation, the image density control portion 36 performs the operation of correcting the image density again (step 220).

Figure 8A:
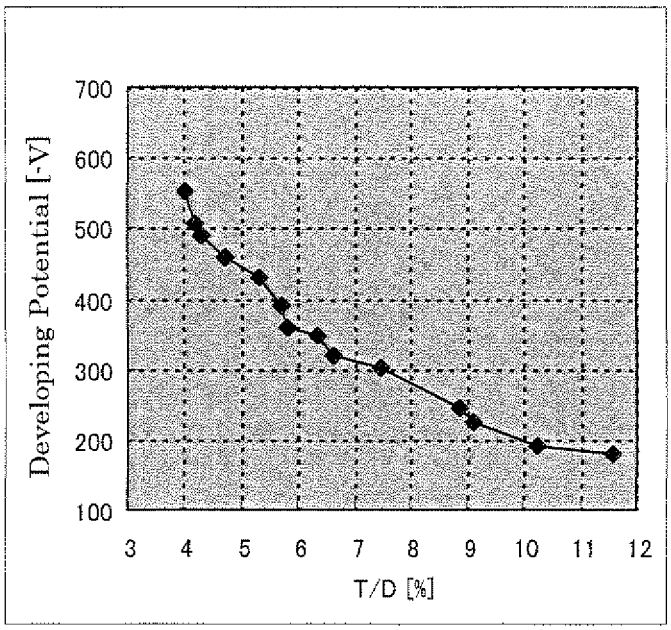
FIG. 8A shows an example of a diagram showing a relation between a toner density of a developer and a developing bias in the image forming apparatus according to the present embodiment.
Figure 8B:
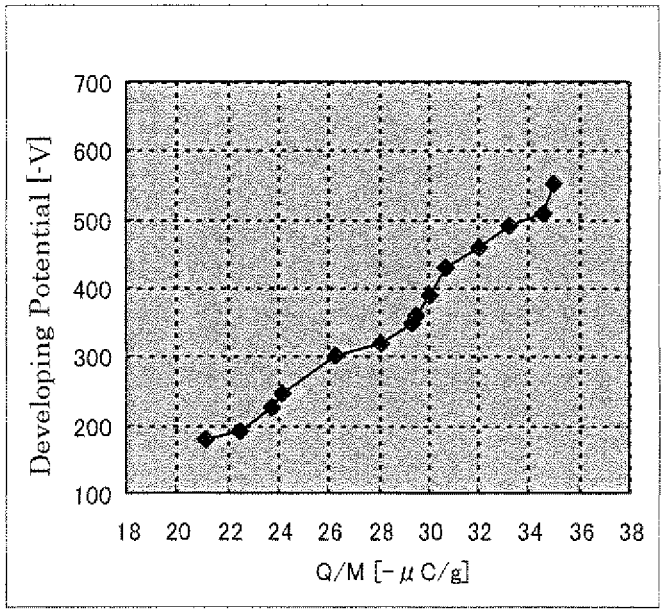
FIG. 8B shows an example of a diagram showing a relation between a toner density of a developer and a developing bias in the image forming apparatus according to the present embodiment.

Next, description will be given for a relation between the toner density in the developer and the developing bias with reference to FIG. 8A and FIG. 8B.

In the image forming apparatus 100 of the present embodiment, as the developing bias varies, the toner density also varies. Here, the relation between the toner density and the developing bias is such that the toner density increases as the developing bias becomes low as shown in FIG. 8A. In addition, the relation between the developing bias and the charge amount of the toner is such that the charge amount of the toner also varies as the developing bias varies. As shown in FIG. 8B, the charge amount of the toner also increases as the developing bias increases. That is, by changing the developing bias, it is possible to control the correction of the toner density.

What is claimed is:

1. An image forming apparatus comprising:

a toner storage portion for storing a toner and, a carrier;

a developing portion for performing development using a dual-component developer including the toner and the carrier;

a toner replenishing portion for replenishing the toner from the toner storage portion to the developing portion;

a toner density detecting portion for detecting a toner density of the developing portion;

a photoreceptor drum for carrying a toner image visualized by the developing portion;

a toner patch forming portion for forming a toner patch for detecting an image density on the photoreceptor drum;

an image density detecting portion for detecting a density of the toner patch; and a storage portion for storing a density of a reference toner patch serving as a reference of an image density and a reference developing bias value to be applied to the developing portion, an image density control portion for comparing the density of the toner patch that is detected and the density of the reference toner patch to correct the image density; and a toner density control portion for controlling a developing bias value to be applied to the developing portion in such a manner as to fall within a first developing potential control range determined by a first upper threshold and a first lower threshold, wherein when a difference between the reference developing bias value and a developing bias value after correction of the image density exceeds the first upper threshold, the toner density control portion performs control to consume toner forcibly, and when the difference between the reference developing bias value and the developing bias value after correction of the image density exceeds the first lower threshold, the toner density control portion performs control to replenish toner forcibly, the image density control portion corrects the image density again after performing the control of toner replenishment or the control of toner consumption, the toner density control portion performs control in such a manner that the developing bias value after correction of the image density falls within a second developing potential control range determined by a second upper threshold and a second lower threshold, and the toner density control portion, when the difference between the reference developing bias value and the developing bias value after correction of the image density exceeds the second upper threshold, performs control to consume toner forcibly, and when the difference between the reference developing bias value and the developing bias value after correction of the image density exceeds the second lower threshold, performs control to replenish toner forcibly.

2. The image forming apparatus according to claim 1, wherein an absolute value of the second developing potential control range is smaller than an absolute value of the first developing potential control range.

3. The image forming apparatus according to claim 1, wherein the image density control portion, when the developing bias value after correction of the image density exceeds the first upper threshold, performs control in such a manner as to decrease a toner replenishment amount to be supplied to the toner storage portion, and when the developing bias value after correction of the image density exceeds the first lower threshold, performs control in such a manner as to increase the toner replenishment amount to be supplied to the toner storage portion.

4. An image forming method using an image forming apparatus including a toner storage portion for storing a toner and a carrier; a developing portion for performing development using a dual-component developer including the toner and the carrier; a toner replenishing portion for replenishing the toner from the toner storage portion to the developing portion; a toner density detecting portion for detecting a toner density of the developing portion; a photoreceptor drum for carrying a toner image visualized by the developing portion; a toner patch forming portion for forming a toner patch for detecting an image density on the photoreceptor drum; an image density detecting portion for detecting a density of the toner patch; and a storage portion for storing a density of a reference toner patch serving as a reference of an image density and a reference developing bias value to be applied to the developing portion, comprising:

an image density control step of comparing the density of the toner patch that is detected and the density of the reference toner patch to correct the image density;

a toner density control step of controlling a developing bias value to be applied to the developing portion in such a manner as to fall within a first developing potential control range determined by a first upper threshold and a first lower threshold;

a toner replenishing step of performing control to consume toner forcibly, when a difference between the reference developing bias value and a developing bias value after correction of the image density exceeds the first upper threshold; and a toner consuming step of performing control to replenish toner forcibly, when the difference between the reference developing bias value and the developing bias value after correction of the image density exceeds the first lower threshold, an image density control repeating step of correcting the image density again after performing the control of toner replenishment or the control of toner consumption;

a second toner density control step of performing control in such a manner that the developing bias value after correction of the image density falls within a second developing potential control range determined by a second upper threshold and a second lower threshold;

a second toner replenishing step of performing control in such a manner as to consume toner forcibly, when the difference between the reference developing bias value and the developing bias value after correction of the image density exceeds the second upper threshold; and a second toner consuming step of performing control in such a manner as to replenish toner forcibly, when the difference between the reference developing bias value and the developing bias value after correction of the image density exceeds the second lower threshold.

* * * * *